US005762767A

United States Patent [19]

Yamada et al.

[11] Patent Number: 5,762,767

[45] Date of Patent: Jun. 9, 1998

[54] AUTOMATIC TRANSFERRING AND PROCESSING APPARATUS OF CATHODE AND METHOD THEREOF

[75] Inventors: Tomizo Yamada; Rintaro Togashi; Nobumi Ueno; Sukehiro Sutou, all of Akita; Kiyoshi Yamada, Chiba; Tatsumi Inamura, Akita, all of Japan

[73] Assignees: Akita Zinc Co., Ltd., Akita; Dowa Mining Co., Ltd., Tokyo, both of Japan

[21] Appl. No.: 780,623

[22] Filed: Jan. 8, 1997

[51] Int. Cl.[6] ..... C25D 17/00

[52] U.S. Cl. ..... 204/198; 204/202; 204/297 R; 204/297 W

[58] Field of Search ..... 204/198, 202, 204/297 R, 297 W

[56] References Cited

U.S. PATENT DOCUMENTS

| | | | |
|---|---|---|---|
| 4,035,280 | 7/1977 | Deane et al. | 204/297 R |
| 4,318,793 | 3/1982 | Ando et al. | 204/198 |
| 4,326,937 | 4/1982 | Neumeier et al. | 204/198 |
| 4,840,716 | 6/1989 | Angelini | 204/297 R |
| 5,100,516 | 3/1992 | Nishimura et al. | 204/198 |
| 5,635,042 | 6/1997 | Shim et al. | 204/297 R |

FOREIGN PATENT DOCUMENTS

| | | |
|---|---|---|
| 51-39848 | 4/1976 | Japan . |
| 8-175659 | 7/1996 | Japan . |

*Primary Examiner*—Bruce F. Bell
*Attorney, Agent, or Firm*—Nilles & Nilles S.C.

[57] ABSTRACT

An automatic transferring and processing apparatus of a cathode and method thereof. A cathode having an electro-deposited metal is taken out of an electrolytic cell, rotated by a stock cathode pivot, transferred through a stock moving carriage and stock conveyor to a processor for processing an electro-deposited metal disposed on the cathode, transferred through an alignment conveyor and an alignment moving carriage to an alignment cathode pivot, rotated by the alignment cathode pivot, and inserted into a predetermined electrolytic cell.

12 Claims, 7 Drawing Sheets

AUTOMATIC TRANSFERRING AND PROCESSING APPARATUS OF CATHODE AND METHOD THEREOF

BACKGROUND OF THE INVENTION

1. Field of the Invention

This invention relates to an automatic transferring and processing apparatus of a cathode and method thereof, and more particularly relates to an automatic transferring and processing apparatus of a cathode and method thereof for inserting a blank cathode into an electrolytic cell in order to electro-win or electro-refine, and taking out the cathode from the electrolytic cell in order to strip an electro-deposited non-ferrous metal such as copper and zinc deposited on the cathode.

2. Description of the Prior Art

A conventional automatic transferring and processing apparatus of a cathode is disclosed in the Japanese Patent Laid-Open No. 39848/1976, for example.

In said apparatus, a manipulator is suspended by an overhead travelling crane arranged above an electrolytic cell for electro-wining or electro-refining a non-ferrous metal. By said manipulator which can be moved horizontally and vertically, blank cathodes are taken out of a carriage and supplied into the electrolytic cell. Further, cathodes each having an electro-deposited metal are taken out of the electrolytic cell and loaded on a carriage.

The above-mentioned apparatus has such defects as mentioned below.

(1) In the automatic transferring apparatus wherein a blank cathode is inserted into an electrolytic cell, taken out of the electrolytic cell and transferred to an electro-deposited metal stripping means, a device for rotating the cathode so that one side of the cathode on which an electric contact is provided is faced to a predetermined side of the electro-deposited metal stripping means is provided, so that the automatic transferring apparatus is heavy and difficult to fit to the established electrolytic refining plant.

(2) An electric bus bar is soiled frequently, so that there is a possibility of firing.

(3) If the stop position of the transferring apparatus is required always with a precision of 5 mm, the apparatus becomes high in installation cost, and a long time must be spent to stop the transferring apparatus at a predetermined position with said required precision, so that a long operation time must be required.

(4) Swing suppressing arms extending along both sides of the cathode are provided in order to prevent the cathode from swinging when the cathodes are inserted into the electrolytic cell and taken out therefrom.

However, in the case where the distance between the adjacent two cathodes is so small, such as not more than 70 mm, if said two adjacent cathodes are approached to each other, the transferring apparatus may catch said two adjacent cathodes together and insert them into adjacent two anodes in the electrolytic cell.

SUMMARY OF THE INVENTION

An object of the present invention is to obviate such defects.

Another object of the present invention is to provide an automatic transferring and processing apparatus of a cathode characterized by comprising a movable means for inserting a blank cathode and taking out a cathode having an electro-deposited metal from an electrolytic cell, a stock cathode pivot, a processing means for processing an electro-deposited metal deposited on said cathode, a stock conveyor for transferring the cathode on said stock cathode pivot to said means for processing the electro-deposited metal, a stock moving carriage for transferring the cathode on said stock cathode pivot to said stock conveyor, an alignment conveyor for receiving the processed cathode from said processing means, an alignment cathode pivot, an alignment moving carriage for transferring the cathode on said alignment conveyor to said alignment cathode pivot, and a guide rail for moving said movable means between said electrolytic cell and said stock cathode pivot and between said electrolytic cell and said alignment cathode pivot.

Said cathode pivot is rotated by at least 180°.

Said stock cathode pivot, stock conveyor, processing means for processing the electro-deposited metal, alignment conveyor, and alignment cathode pivot are arranged in this order.

Said movable means comprises a frame, a positioning pin which is moved up and down relative to said frame, so that it is removed from and inserted into a positioning pin hole provided on said electrolytic cell, and a X-Y table for moving said frame in one direction and the other direction which is normal to said one direction relative to said guide rail.

Said movable means has means for suppressing a swing of said cathode comprising a holding bar having a groove into which an upper end portion of said cathode is inserted, and a suppressing bar in the shape of beads arranged side by side which are faced to a side end of said cathode.

Said holding bar has a lower end facing to an upper end of an anode arranged in said electrolytic cell.

The automatic transferring and processing apparatus further comprises a washing means for washing a bus bar provided in said electrolytic cell, said washing means having a brush which can be moved up and down, rotated and slided relative to said frame.

Said washing means has a spray nozzle for spraying water on the surface of said bus bar.

Further object of the present invention is to provide an automatic transferring and processing method of a cathode comprising the steps of taking out a cathode from an electrolytic cell, setting the cathode on a stock cathode pivot, rotating the stock cathode pivot by a predetermined angle, transferring the cathode on said stock cathode pivot to a processing means for processing an electro-deposited metal deposited on said cathode through a stock conveyor, taking out the cathode from said processing means and transferring it through an alignment conveyor to an alignment cathode pivot, rotating the alignment cathode pivot by a predetermined angle, and inserting the cathode on the alignment cathode pivot into said electrolytic cell.

Said processing means is an electro-deposited metal stripping means.

The automatic transferring and processing method of the present invention further comprises a step of washing a bus bar provided in said electrolytic cell by washing means before the cathode is inserted into or taken out of said electrolytic cell.

The foregoing and other objects, features, and advantages of the present invention will become apparent from the following more particular description of a preferred embodiment of the invention, as illustrated in the accompanying drawings.

DESCRIPTION OF THE PREfERRED EMBODIMENT

Figure 1:
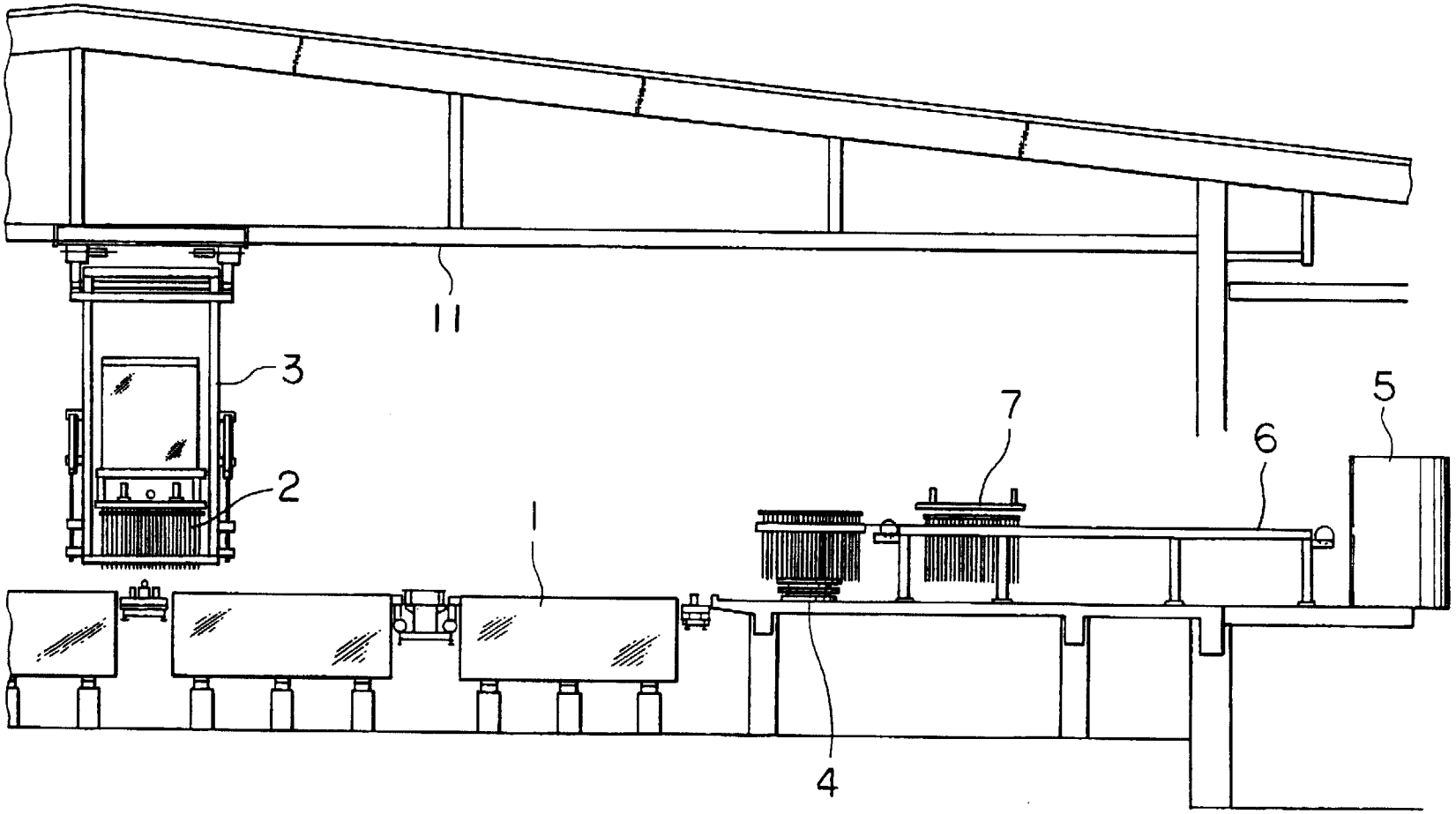
FIG. 1 is a front view of an a automatic transferring and processing apparatus in accordance with the present invention.
Figure 2:
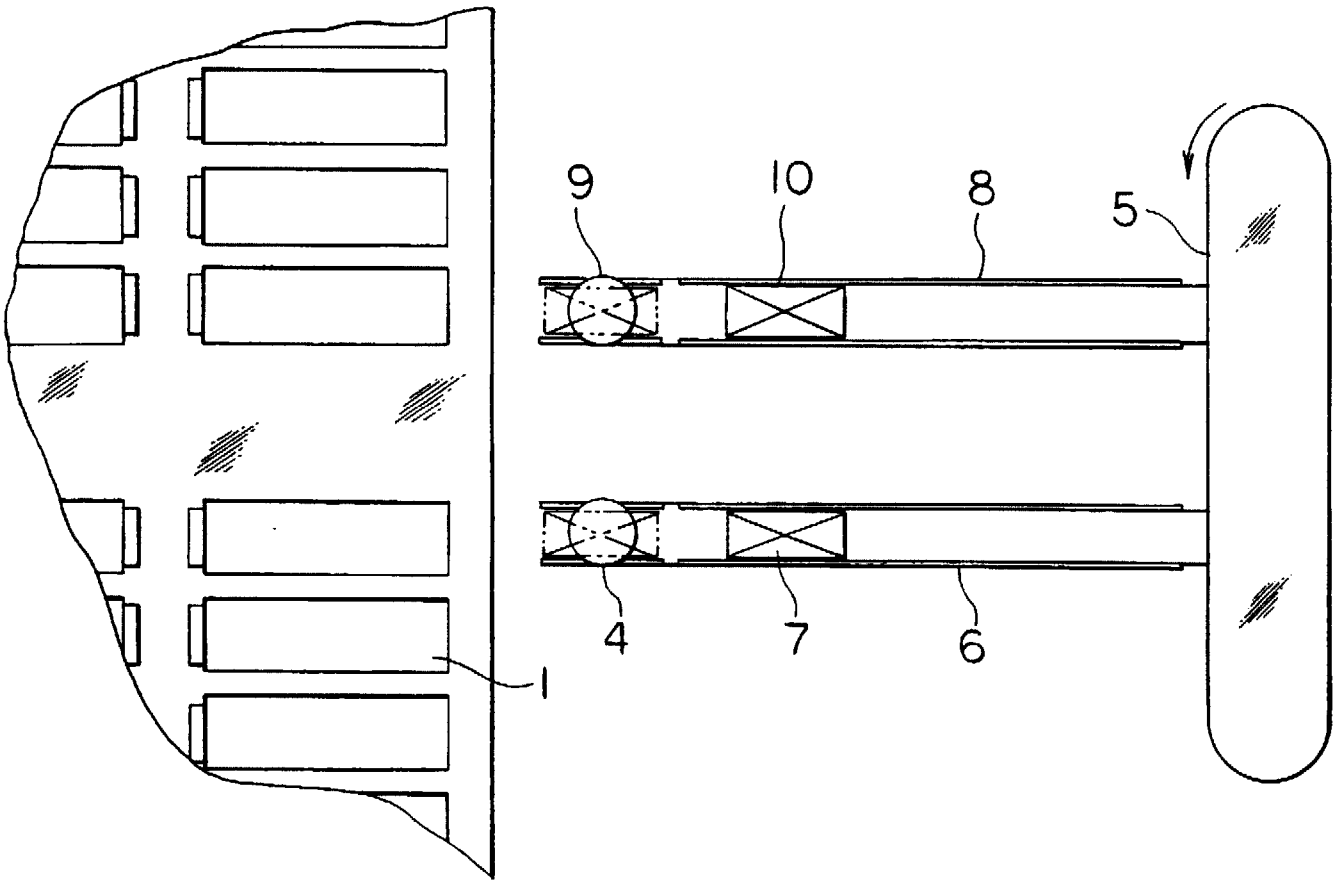
FIG. 2 is a plan view of the automatic transferring and processing apparatus in accordance with the present invention.

As shown in FIGS. 1 and 2, an automatic transferring and processing apparatus of a cathode according to the present invention comprises a movable means 3 for inserting a group of a plurality of blank cathodes 2 into an electrolytic cell 1 and taking out a group of a plurality of cathodes 2 each having an electro-deposited non-ferrous metal from said electrolytic cell 1, a stock cathode pivot 4 for receiving the group of the cathodes 2 from said movable means 3 to rotate the group of the cathodes 2 by 180°, a processing means 5 for stripping the electro-deposited metal deposited on each of said cathodes 2, a stock conveyor 6 for transferring said group of the cathodes 2 to said processing means 5 intermittently, a stock moving carriage 7 for transferring the group of the cathodes 2 on said stock cathode pivot 4 to said stock conveyor 6, an alignment conveyor 8 for receiving the cathodes 2 one by one from said processing means, an alignment cathode pivot 9 for receiving the group of the cathodes 2 from said alignment conveyor 8 to rotate the group of the cathodes by 180°, an alignment moving carriage 10 for transferring the group of the cathodes on said alignment conveyor 8 to said alignment cathode pivot 9, and a guide rail 11 for moving said movable means between said electrolytic cell 1 and said stock cathode pivot 4, and between said electrolytic cell 1 and said alignment cathode pivot 9.

Said stock cathode pivot 4, stock conveyor 6, processing means 5 for processing the electro-deposited metal, alignment conveyor 8, and alignment cathode pivot 9 are arranged in this order and connected endlessly through said electrolytic cell 1.

Figure 3:
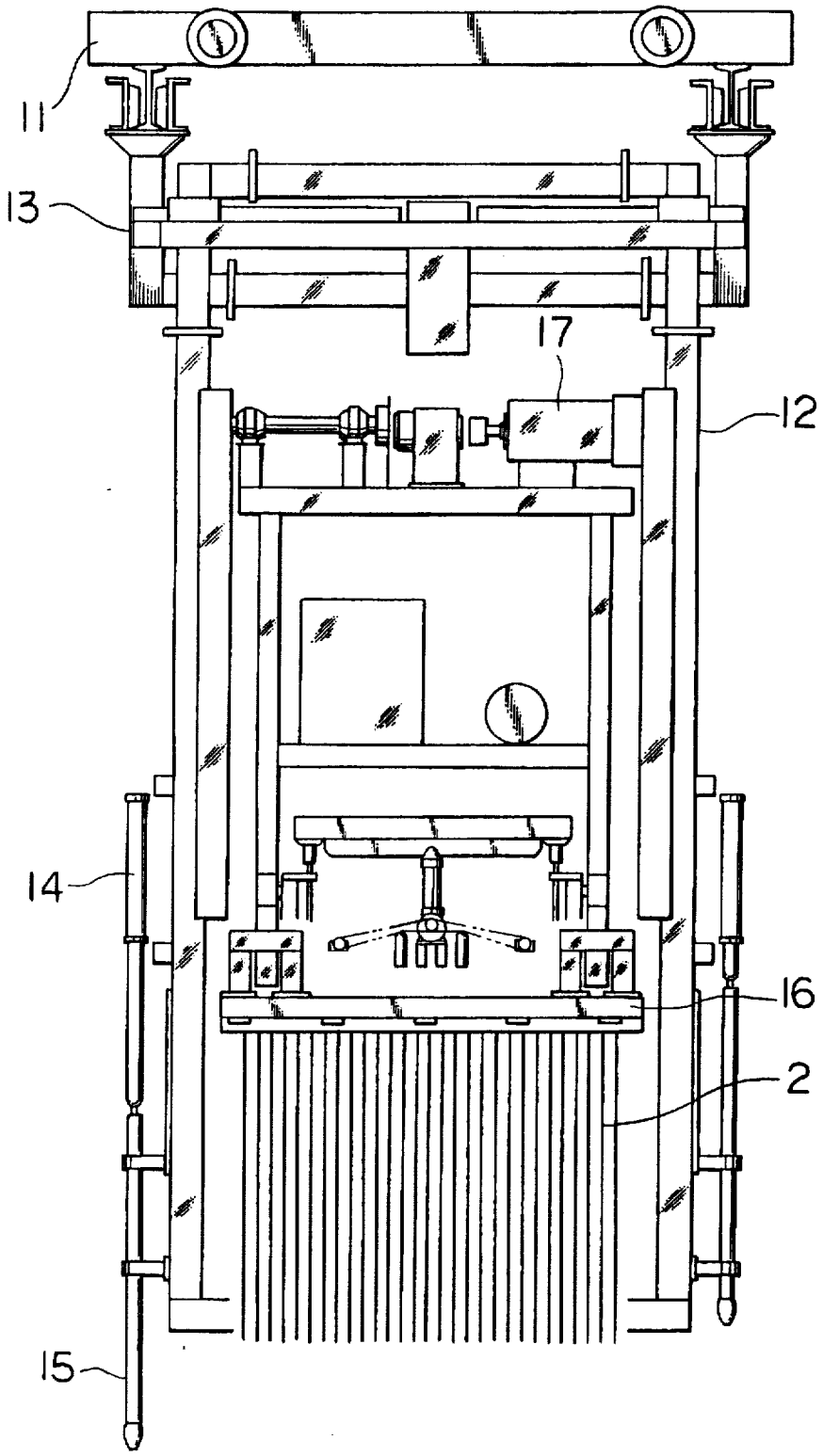
FIG. 3 is a front view of a movable means for inserting and taking out a cathode in the automatic transferring and processing apparatus in accordance with the present invention.

As shown in FIG. 3, said movable means 3 comprises a frame 12, positioning pins 15 which are moved up and down by cylinders 14 along said frame 12, so that they are removed from and inserted into positioning pin holes (not shown) provided on said a electrolytic cell 1, a X-Y table 13 for moving said frame 12 in one direction and the other direction which is normal to said one direction relative to said guide rail 11, said X-Y table 13 being arranged between said frame 12 and said guide rail 11, a holding means 16 for holding the group of the cathodes 2 detachably, and a motor 17 for moving up and down said holding means 16 relative to said frame 12.

Figure 4:
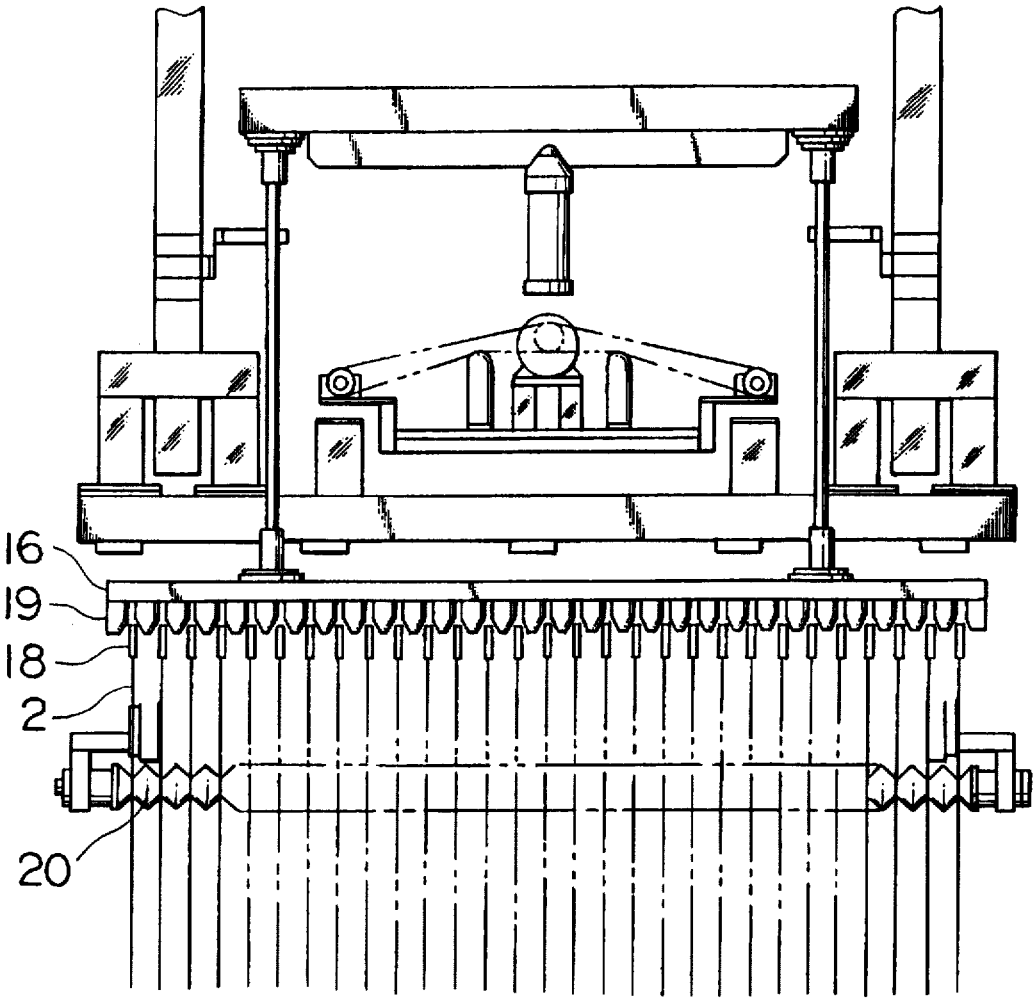
FIG. 4 is a front view of a suspending means in the automatic transferring and processing apparatus in accordance with the present invention.
Figure 5:
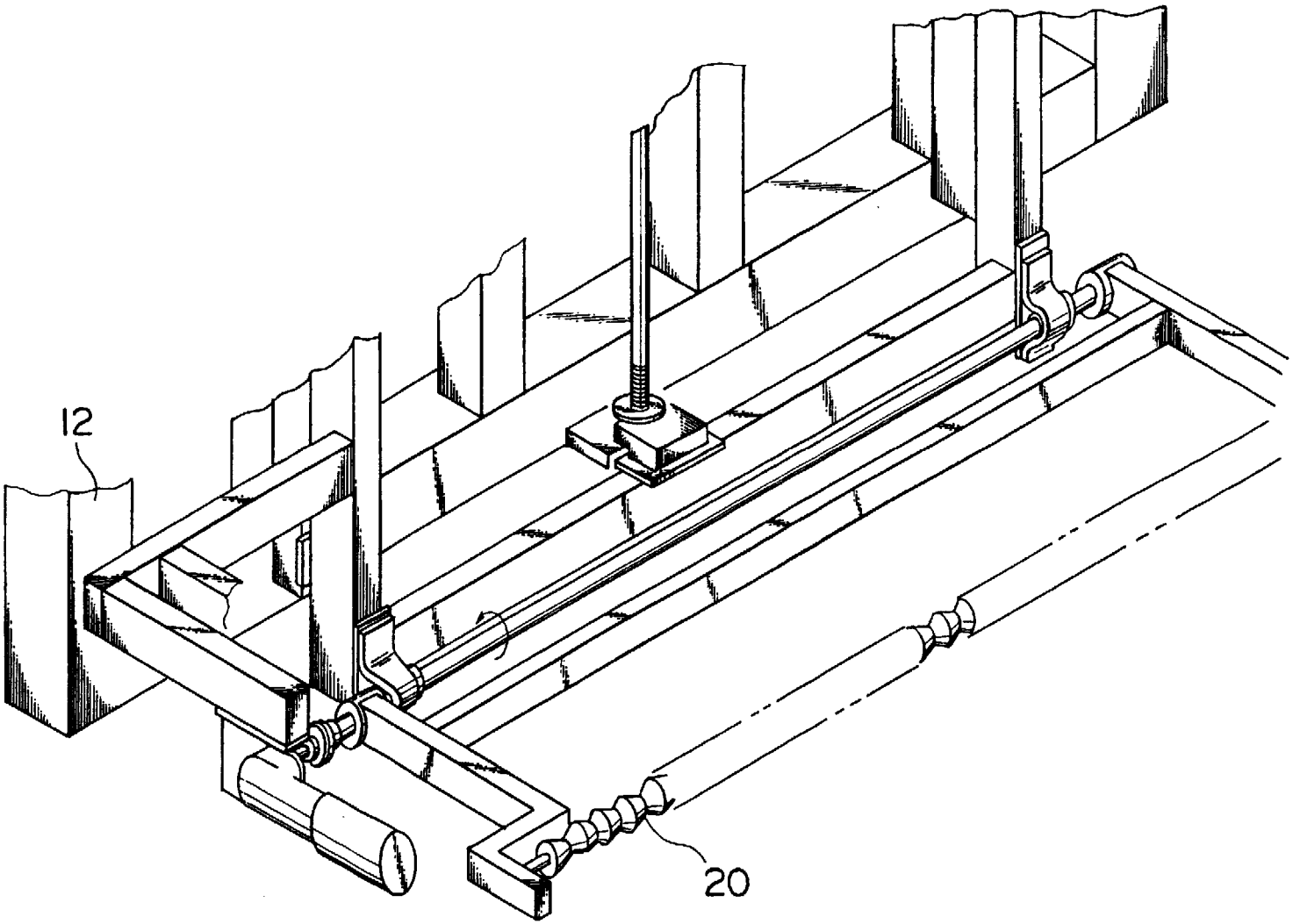
FIG. 5 is a perspective view of a swing suppressing means in the automatic transferring and processing apparatus in accordance with the present invention.

As shown in FIGS. 4 and 5, said movable means 3 has a holding bar 19 and a swing suppressing bar 20.

Said holding bar 19 can be moved up and down freely by a distance with respect to said holding means 16.

Grooves into which upper end portions 18 of said cathodes 2 can be inserted, respectively, are formed on the lower surface of said holding bar 19.

The lower end of said holding bar 19 faces to upper ends of anodes (not shown) arranged in the electrolytic cell 1.

Said swing suppressing bar 20 is in the shape of beads arranged side by side, and can be moved up and down and rotated with respect to said frame 12, so that when it is rotated, it is brought into contact with side ends of said cathodes 2 to suppress the swing of the cathodes 2.

Figure 6:
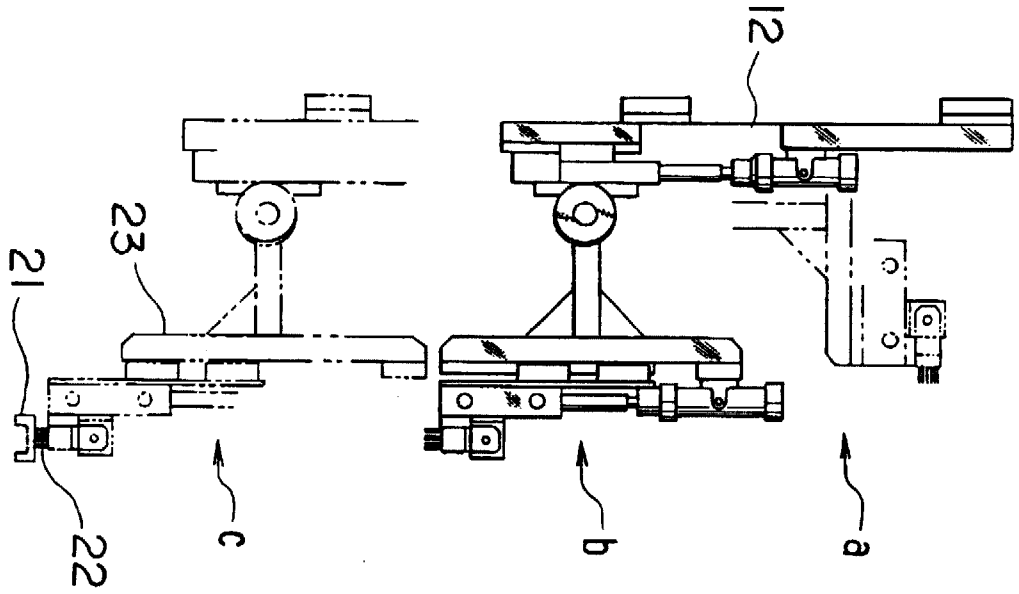
FIG. 6 is a front view of a bus bar washing means in the automatic transferring and processing apparatus in accordance with the present invention.
Figure 7:
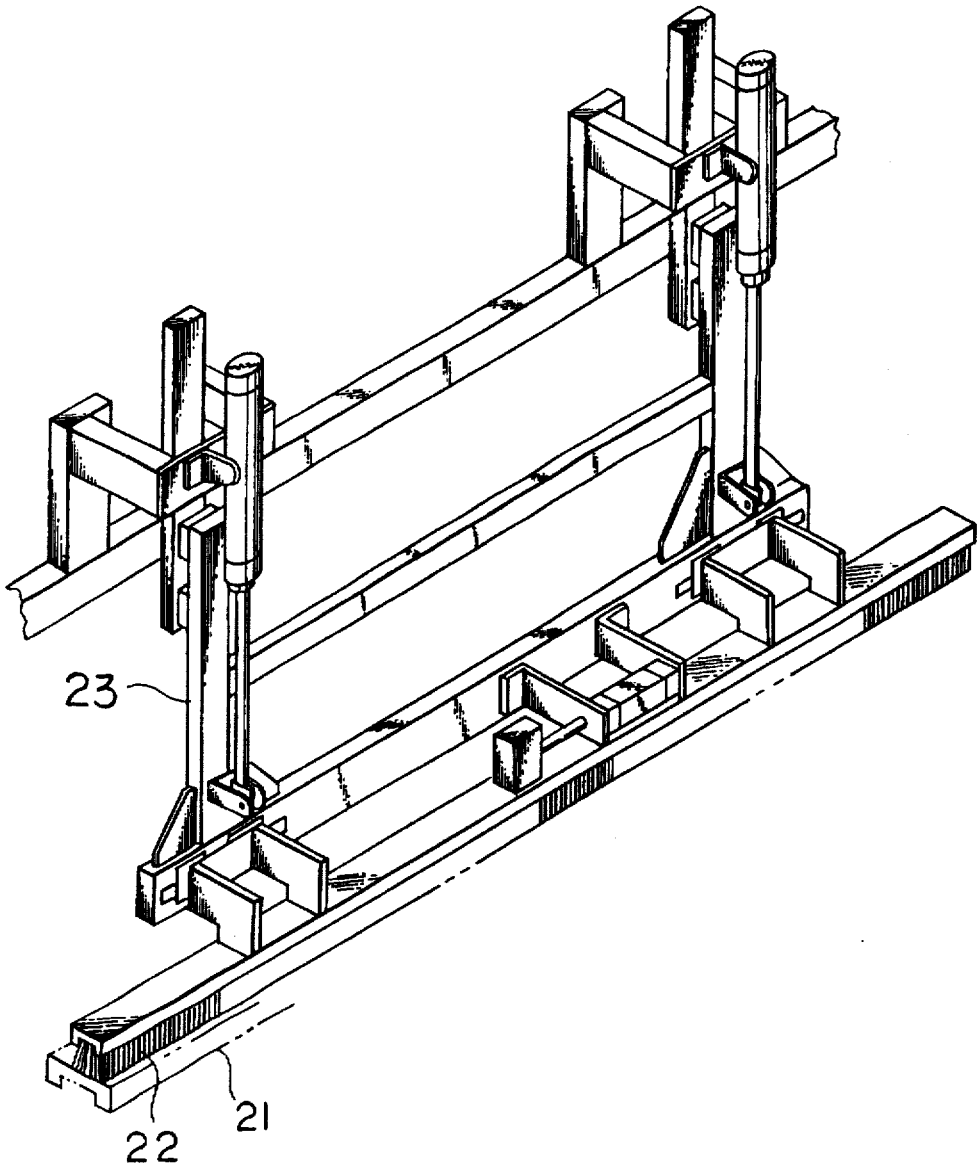
FIG. 7 is a perspective view of the bus bar washing means in the automatic transferring and processing apparatus in accordance with the present invention.

As shown in FIGS. 6 and 7, said movable means 3 further comprises a washing means 23 for washing with water a bus bar 21 provided in said electrolytic cell 1 in order to supply an electric current to electrodes therein.

Said washing means 23 has a brush 22 which can be moved up and down and, rotated relative to said frame 12, and slided by 100 mm, for example, along said bus bar 21 while contacting with it.

Figure 8:
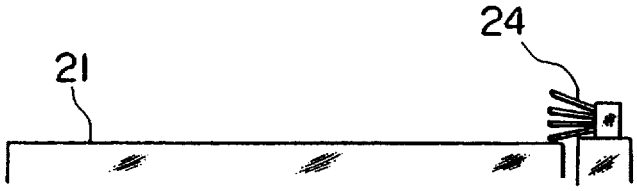
FIG. 8 is a front view of a water spray nozzle for washing the bus bar in the automatic transferring and processing apparatus in accordance with the present invention.

Further, as shown in FIG. 8, a plurality of water spray nozzles 24 are arranged at an end of said bus bar 21 so that the water spray positions are different from one other.

In this construction, water can be sprayed by said water spray nozzles 24 on the entire surface of said bus bar 21 at any time such as said washing means 23 is operated.

A cathode transferring and processing method of the present invention will now be explained hereunder.

In the electrolytic cell 1, 58 sheets of the cathode 2 and 59 sheets of the anode, for example, are inserted so that each cathode and each anode are arranged alternately with a gap therebetween.

The half number of said cathodes 2, for example, is taken out from or inserted into the electrolytic cell 1 at a time.

When the cathode 2 is to be taken out, said movable means 3 is moved along said guide rail 11 on a predetermined electrolytic cell 1, and as shown in FIG. 3, the lower end of said positioning pin 15 is inserted into the positioning pin hole provided on the electrolytic cell 1 by operating the cylinder 14.

Because the tip end of said positioning pin 15 is tapered, it is easy to insert the tip end into the positioning pin hole.

When the tip end is inserted into the positioning pin hole, the frame 12 is moved slightly through the X-Y table 13 according to the position of the positioning pin 15, so that the frame 12 can be set at a predetermined position with fidelity.

As a result, the holding means 16 can be set at a predetermined position with the precision of not more than 5 mm even if a stop means of low precision is used.

When the holding means 16 is lowered relative to the frame 12 by operating the motor 17, the groove at the lower surface of the holding bar 19 is brought into engagement with the upper beam of the cathode 2 in the electrolytic cell, and the lower end of the holding bar 19 is brought into contact with the anode.

Further, said holding means 16 is lowered relative to said frame 12, and each cathode 2 is held by the fingers of the holding means 16.

When said holding means 16 is started to move upwardly said holding bar 19 is not lifted and the lower end of the holding bar 19 is brought into contact with the upper beam of the anode, so that the anode can be prevented from being lifted, and only the cathode 2 can be lifted.

Further, said holding bar 19 separates adjacent cathodes 2 each other, so that the holding means 16 is prevented from catching two adjacent cathode 2 together.

When the group of the cathodes 2 is lifted, said swing suppressing bar 20 is lowered relative to the frame 12, rotated by 90° and brought into contact with the side ends of the cathodes 2 as shown in FIGS. 4 and 5, so that the swing of cathode 2 can be suppressed sufficiently.

After the group of the cathodes 2 is lifted, the positioning pin 15 is lifted by the cylinder 14, and said movable means 3 is moved along the guide rail 11 to said stock cathode pivot 4 show in FIGS. 1 and 2, and then the group of the cathodes 2 is loaded on said stock rotary carriage 4.

In case that the group of the cathodes 2 is inserted into the electrolytic cell 1, the above steps are carried out in the inverse order. Said washing means 23 and water spray nozzles 24 are operated so that the bus bar 21 is washed if necessary before the group of the cathodes 2 is moved.

Specifically, as shown in FIG. 6, after the cathode 2 is taken out and before the cathode 2 is inserted into the electrolytic cell 1, the washing means 23 is turned from an upper inoperative position a to an intermediate position b and then lowered to a lower operative position c, so that the brush 22 at the lower end of the washing means 23 is brought into contact with the surface of the bus bar 21.

In this state, only the brush 22 is moved along the bus bar 21 by a stroke of 100 mm, for example, while spraying water through the spray nozzle 24.

In said processing means 5, the electro-deposited metal is stripped from the cathode 2 starting from one side thereof on which the electric contact is provided.

Accordingly, the cathodes 2 on the stock cathode pivot 4 are rotated by 180°, for example, so that said one side thereof faces to the entrance of the processing means 5.

The cathodes 2 on the stock cathode pivot 4 are then moved by the stock moving carriage 7 to the stock conveyor 6 and supplied one by one to the entrance of the processing means 5 according to the timing of the processing.

The cathodes 2 from which the electro-deposited metals are stripped are moved one by one from the processing means 5 to the alignment conveyor 8 and transferred to the alignment cathode pivot 9 by the alignment moving carriage 10.

The cathodes 2 on said alignment cathode pivot 9 are rotated by 180°, for example, in the clockwise direction or the counter-clockwise direction, and moved by the movable means 3 along the guide rail 11 on a required electrolytic cell 1 and inserted therein.

The position of the movable means 3 can be detected by a conventional proximity switch.

However, such proximity switch is affected easily by the magnetic flux induced by the electrolysis current.

Accordingly, it is preferable that the motion of the movable means 3 relative to the guide rail 11 is detected by the combination of rack and pinion to rotate the rotary encoder, and the position of said movable means 3 is detected by the revolution number of said rotary encoder.

By such arrangement, the above defect can be obviated and the precision of about 1 mm can be attained.

As stated above, according to the automatic transferring and processing apparatus of the cathode and method thereof in accordance with the present invention, it is not necessary to provide any rotary means on the movable means for inserting the cathode into the electrolytic cell and taking out the cathode therefrom, so that the movable means becomes light in weight, and that the transferring of the cathode can easily be carried out with high fedility.

It will be understood that the foregoing details are given for purpose of illustration, not restriction, and that the variations within the spirit of this invention are intended to be included within the scope of the appended claims.

What is claimed is:

1. An automatic transferring and processing apparatus of a cathode characterized by comprising a movable means for inserting a blank cathode and taking out a cathode having an electro-deposited metal from an electrolytic cell, a stock cathode pivot, a processing means for processing an electro-deposited metal deposited on said cathode, a stock conveyor for transferring the cathode on said stock cathode pivot to said means for processing the electro-deposited metal, a stock moving carriage for transferring the cathode on said stock cathode pivot to said stock conveyor, an alignment conveyor for receiving the processed cathode from said processing means, an alignment cathode pivot, an alignment moving carriage for transferring the cathode on said alignment conveyor to said alignment cathode pivot, and a guide rail for moving said movable means between said electrolytic cell and said stock cathode pivot and between said electrolytic cell and said alignment cathode pivot.

2. The automatic transferring and processing apparatus as claimed in claim 1, wherein said processing means is an electro-deposited metal stripping means.

3. The automatic transferring and processing apparatus as claimed in claim 1, wherein both said cathode pivots have a means for rotating by at least 180°.

4. The automatic transferring and processing apparatus as claimed in claim 1, wherein said stock cathode pivot, stock conveyor, processing means for processing the electro-deposited metal, alignment conveyer, and alignment cathode pivot are arranged in this order.

5. The automatic transferring and processing apparatus as claimed in claim 1, wherein said movable means comprises a frame, a positioning pin which is moved up and down relative to said frame, so that it is removed from and inserted into a positioning pin hole provided on said electrolytic cell, and a X-Y table for moving said frame in one direction and another direction which is normal to said one direction relative to said guide rail.

6. The automatic transferring and processing apparatus as claimed in claim 1, wherein said movable means has means for suppressing a swing of said cathode comprising holding bar having a groove into which an upper end portion of said cathode is inserted, and a swing suppressing bar in the shape of beads arrangedside by side which are faced to a side end of said cathode.

7. The automatic transferring and processing apparatus as claimed in claim 6, wherein said holding bar has a lower end facing to an upper end of an anode arranged in said electrolytic cell.

8. The automatic transferring and processing apparatus as claimed in claim 1, further comprising a washing means for washing a bus bar provided in said electrolytic cell, said washing means having a brush which is moved up and down, rotated and slided relative to said frame.

9. The automatic transferring and processing apparatus as claimed in claim 8, wherein said washing means has a spray nozzle for spraying water on the surface of said bus bar.

10. An automatic transferring and processing method of a cathode characterized by comprising the steps of taking out a cathode from an electrolytic cell, setting the cathode on a stock cathode pivot, rotating the stock cathode pivot by a set angle, transferring the cathode on said stock cathode pivot to a processing means for processing an electro-deposited metal deposited on said cathode through a stock conveyor, taking out the cathode from said processing means and transferring it through an alignment conveyor to an alignment cathode pivot, rotating the alignment cathode pivot by a set angle, and inserting the cathode on the alignment cathode pivot into said electrolytic cell.

11. The automatic transferring and processing method as claimed in claim 10, wherein said processing means strips the electro-deposited metal.

12. The automatic transferring and processing method as claimed in claim 10, further comprising a step of washing a bus bar provided in said electrolytic cell by a washing means before the cathode is inserted into or taken out of said electrolytic cell.

* * * * *